US006674630B1

(12) United States Patent
Gefter et al.

(10) Patent No.: US 6,674,630 B1
(45) Date of Patent: Jan. 6, 2004

(54) SIMULTANEOUS NEUTRALIZATION AND MONITORING OF CHARGE ON MOVING MATERIAL

(75) Inventors: Peter Gefter, South San Francisco, CA (US); Mark Blitshteyn, New Hartford, CT (US)

(73) Assignee: Ion Systems, Inc., Berkeley, CA (US)

( * ) Notice: Subject to any disclaimer, the term of this patent is extended or adjusted under 35 U.S.C. 154(b) by 280 days.

(21) Appl. No.: 09/948,269

(22) Filed: Sep. 6, 2001

(51) Int. Cl.[7] ..... H05F 3/00; B05D 1/26
(52) U.S. Cl. ..... 361/212; 427/472
(58) Field of Search ..... 361/212, 213, 361/230, 235, 236, 233, 229, 214, 221; 427/472, 420, 428, 299

(56) References Cited

U.S. PATENT DOCUMENTS 4,477,263 A * 10/1984 Shaver et al. ..... 95/7
4,517,143 A * 5/1985 Kisler ..... 264/484
4,810,432 A * 3/1989 Kisler ..... 264/484
4,951,172 A * 8/1990 Steinman et al. ..... 361/213
5,008,594 A * 4/1991 Swanson et al. ..... 315/111.81
5,930,105 A 7/1999 Pitel et al.
6,088,211 A * 7/2000 Pitel ..... 361/212
6,242,051 B1 * 6/2001 Zaretsky ..... 427/472
6,524,660 B2 * 2/2003 Quiel et al. ..... 427/472

* cited by examiner

*Primary Examiner*—Rajnikant B. Patel
(74) *Attorney, Agent, or Firm*—Fenwick & West LLP

(57) ABSTRACT

Simultaneous neutralization and monitoring of charge on a moving dielectric material is achieved with ionizing devices that supply ions in proximity to the material to thereby substantially neutralize charge on the material, and with circuitry that senses the ion currents flowing from the ionizing devices to the material. A controller can be utilized to control the ionizing devices and/or calculate various parameters (such as charge densities on the web, efficiency, etc.) based on the sensed ion currents.

30 Claims, 2 Drawing Sheets

SIMULTANEOUS NEUTRALIZATION AND MONITORING OF CHARGE ON MOVING MATERIAL

FIELD OF INVENTION

The present invention relates to the field of measuring and neutralizing electrostatic charge on moving dielectric materials. More particularly, the invention relates to real-time monitoring of charge density on moving material and the neutralizing efficiency of air ionizing devices in various manufacturing, converting and printing applications.

BACKGROUND OF INVENTION

Surface charge on a continuous length of dielectric material can exist as a net or monopole charge and/or as dipoles of charge in isolated regions. Accumulation of such charge can occur in a wide number of circumstances and with a wide range of dielectric materials such as thin films, webs and threads made of paper, plastic, textiles, etc. Regardless of the form and/or material, however, the accumulation of net surface charge on a dielectric material presents potential electrostatic hazards that often need to be eliminated or significantly reduced. For example, reduction or elimination of net charge is important during operation in hazardous environments such as with an electrostatically-charged web moving in proximity to flammable vapors. Under such circumstances, web charge densities may increase sufficiently to spontaneously generate electrostatic discharges and ignite the flammable vapors.

Static charge on a moving dielectric material can be controlled in a conventional manner using ionized air molecules supplied to the material to neutralize the accumulated charge. For example, web charge is commonly reduced by an electrical, inductive or nuclear type of air ionizing device. To ensure the overall safety and effectiveness of the system, however, it is also necessary to monitor the efficiency of the charge neutralizing process. Conventionally, this is done by sensing the upstream charge density before the neutralization process and by sensing the downstream (or residual) charge density remaining on the surface after the neutralization process. This information can be used to calculate the ratio of the two charge densities that defines the efficiency of the charge neutralization process. Traditionally, such monitoring has been accomplished with dedicated electrostatic field sensors installed upstream and downstream of the neutralizer. Such conventional sensors are separate from, and in addition to the ionizers used to neutralize surface charge. Their use, therefore, introduces cost and complexity into conventional charge neutralization systems.

Most known electrostatic sensors of the type noted above are non-contact devices which are capable of measuring electrostatic field intensity or electrical potential created by a charged web. They are commonly referred to as field meters, electrometers or electrostatic voltmeters. Such devices may be mounted on web processing equipment in proximity to the moving web. In order to monitor web widths in the range of approximately 40" to 80", multi-sensor arrangements are are commonly employed to cover the width of the web. Alternatively, a segmented roller apparatus that operates in direct contact with a moving web may also serve as an electrostatic sensor for measuring charge density on moving webs.

Unfortunately, monitoring devices of the type noted immediately above are relatively expensive and require regular maintenance and calibration to ensure proper operation, especially in hazardous environments. Also, charge measurement with dedicated monitoring devices and charge neutralization with ionizers commonly take place at different physical locations along a web path. This inherently results in delayed ionization response times that vary depending upon the web velocity. This, in turn, may result in a high residual charge being left on the web, especially at higher web velocities, despite the fact that the system is being monitored for effectiveness.

It is also known in the art to measure ion current flowing through a single electrical neutralizer to a charged web by monitoring ground return current as described in U.S. Pat. No. 5,930,105 entitled "Method and Apparatus For Air Ionization." U.S. Pat. No. 5,930,105 issued on Jul. 27, 1999 and is hereby incorporated by reference. Monitoring return ground current as described in U.S. Pat. No. 5,930,105 offers the theoretical possibility that charge density upstream of the neutralizer, as well as the charge density downstream of the neutralizer can be monitored with the use of a single neutralizer. This is only possible, however, in an ideal case where charge neutralization is perfectly achieved over the lifespan of a neutralization system. As a practical matter, however, no such systems exist for a number of reasons. First, ionizer efficiency varies overtime due to deterioration of ionizers through normal wear. Indeed, as ionizers approach the end of their useful lives, their ability to neutralize charge radically decreases. Further, users can also over-tax a neutralizing system by using it in a manner for which it was not intended. This could occur where, for example, the user attempts to neutralize the charge on a material that accumulates unusually high charge, or attempts to run the material at an unusually high velocity. Regardless of the cause, however, such factors all introduce a high level of uncertainty as to whether the intended charge neutralization has actually occurred in a given case. For this reason, conventional charge sensors are utilized in safety-critical applications.

SUMMARY OF INVENTION

In accordance with the present invention, static charges on a moving dielectric material are neutralized and the web charge density values before and after neutralization are determined from real-time monitoring of the ion current flowing from the charge neutralizing ionizers to the material. In particular, the present invention utilizes at least two charge-neutralizing ionizers which also act as charge sensors instead of employing dedicated sensors conventionally combined with dedicated ionizers. In this way, the effectiveness and/or efficiency of charge neutralization can be continuously monitored and the information obtained can be used to control the machinery which handles the dielectric material.

The present invention includes embodiments of a reliable, low-maintenance system with redundancy of charge neutralization and charge monitoring that includes a computer interface for displaying and/or storing information regarding various parameters such as charge density and the status of the charge neutralizers. In one apparatus embodiment of the present invention, a first ionizer responds to the charge density on a moving length of dielectric material to thereby reduce it. A second ionizer responds to any resultant charge which may have remained on the material and further neutralizes the resultant charge until little or no residual charge is left. A controller of the system responds to the sensed currents from the first and second ionizers, calculates various parameters such as the charge density on the moving material and generates control signals which can be used in a number of ways.

DESCRIPTION OF THE DRAWINGS

The various features and advantages of the present invention will be better understood with reference to the accompanying Figures wherein like numerals represent like structures and operations and wherein.

DETAILED DESCRIPTION OF THE PREFERRED EMBODIMENTS

Figure 1:
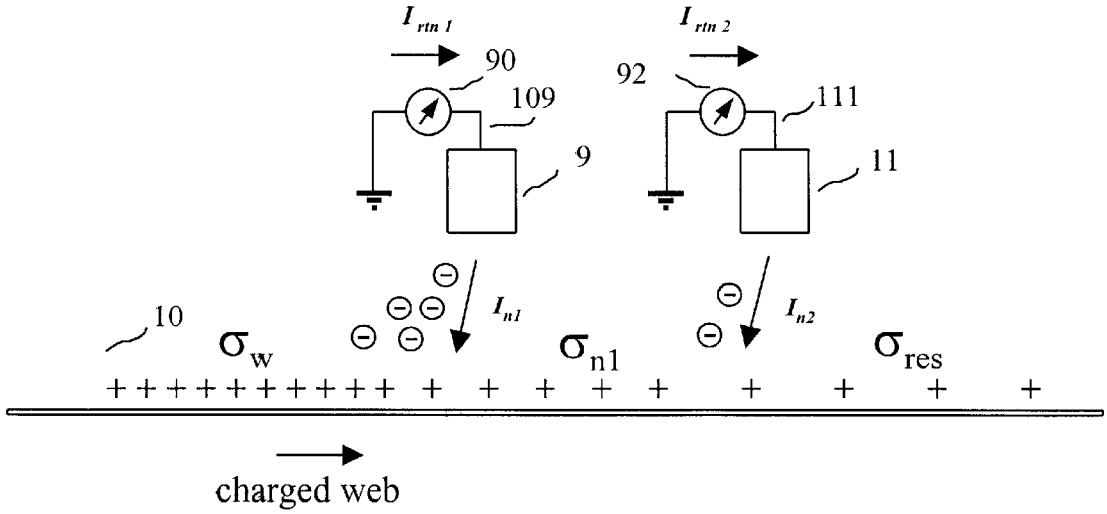
FIG. 1 is an illustration of the operation of web charge monitoring and neutralizing system of the present invention.
Figure 2:
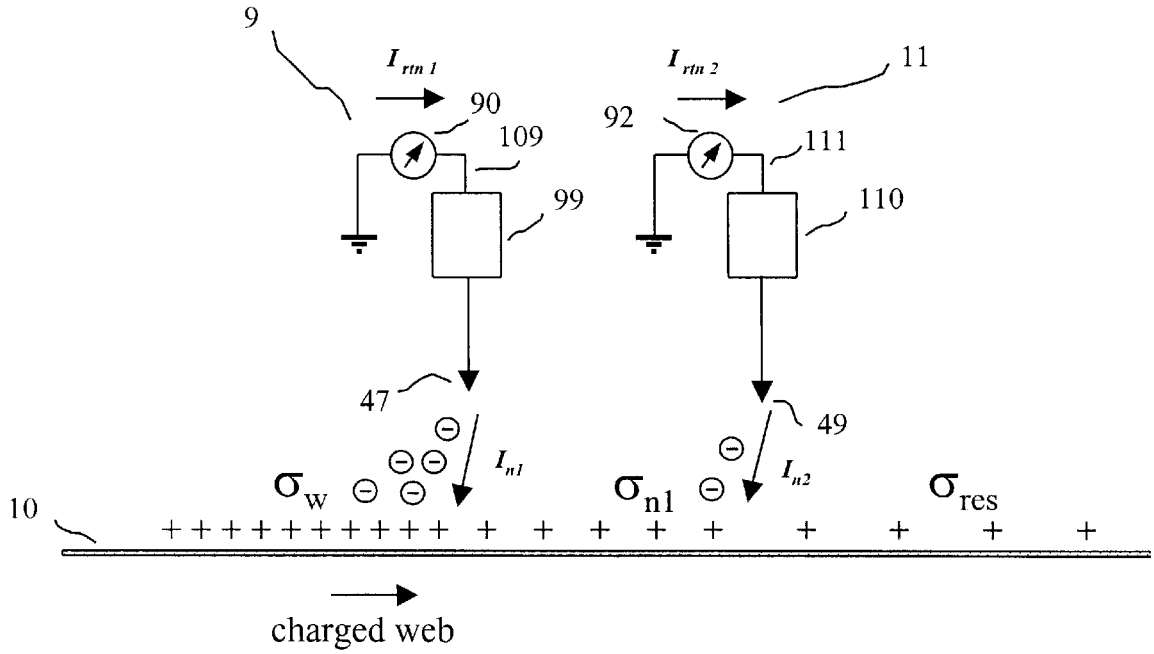
FIG. 2 is an illustration of the operation of web charge monitoring and neutralizing system of the present invention, the embodiment of FIG. 2 using ionizing electrodes.
Figure 3:
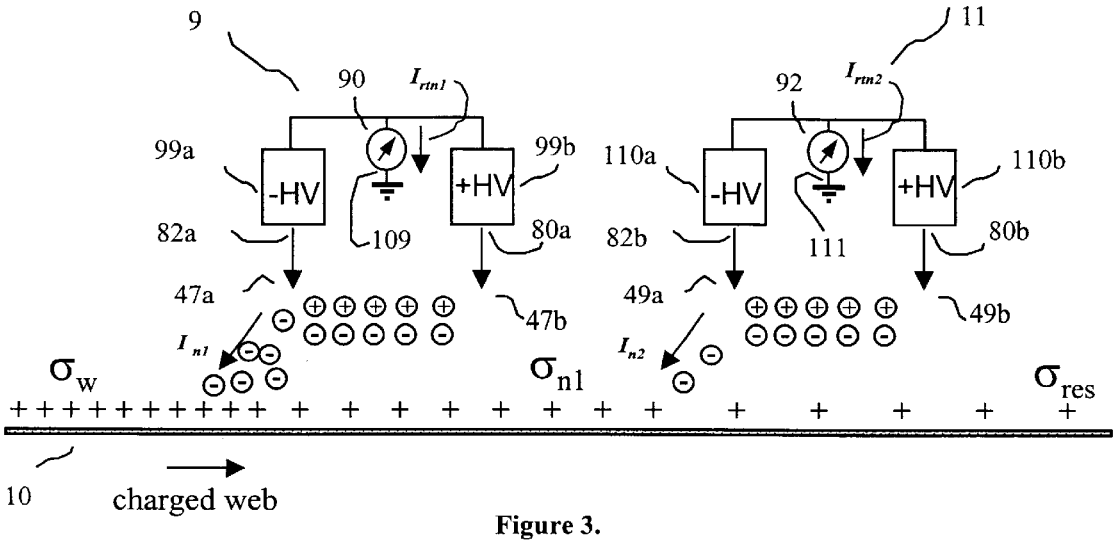
FIG. 3 is an illustration of operation of operation of an embodiment of the invention using bipolar electrical ionizers.

FIGS. 1, 2 and 3 show alternative preferred embodiments of the present invention, these embodiments having many similarities as discussed immediately below. In accordance with these embodiments, two ionizing devices 9 and 11 are preferably installed close to one another (between about 6–60 inches apart) along the course of movement of a dielectric web 10 such as a paper or plastic film within the same span of an unsupported material. However, the ionizing devices can be as close as two inches apart or as far apart as more than one hundred inches. Also, the present invention, is not limited to webs, but can be applied to virtually any of the known forms of dielectric materials and forms known in the art. While web 10 is shown in FIG. 1 as only carrying electrostatic surface charge $\sigma_w$ of one polarity, it will be appreciated that the material may also carry charges of the opposite polarity and that the present invention can be effectively utilized under such conditions.

As shown in FIGS. 1 and 2, ionizers 9 and 11 can be used to continually monitor the initial and residual web charge density on the web by measuring the associated ion currents for each ionizer. These ion currents are preferably continually measured and the ratio of these currents is continually calculated. From that ratio, the initial charge density and the residual charge density is continually calculated as described in greater detail below.

The illustrations of FIGS. 1, 2 and 3 show examples of electrostatic conditions within the neutralization zone of ionizers 9, 11 in position over the charged moving web 10. In accordance with the present invention, each of the two air ionizing devices 9, 11 is preferably operated to produce both positive and negative ions (continually, intermittently or in response to the electrical field of the static charge on the web 10). Specifically, the electrostatic field established between the ionizers 9 and 11 and the web 10 attracts ions of opposite polarity. Ionizer 9 is positioned upstream of the ionizer 11 and an initial charge density $\sigma_w$ appears on the the moving web 10 when it passes the span of the distance upstream of ionizer 9. Web 10 is being partially or completely neutralized by the ionizer 9 to a web charge density of $\sigma_{n1}$ appearing on the span of the distance of the web downstream of the ionizer 9 and upstream of the ionizer 11. That charge is then sensed and neutralized by the downstream ionizer 11 along the span of the distance of web 10 in proximity with the second ionizer 11. The resulting charge density $\sigma_{res}$ is the residual charge density remaining on the span of the distance of the web 10 downstream of the ionizer 11 and is preferably negligible.

As shown in FIGS. 1 and 2, ionizers 9 and 11 are connected to ground via respective return electrical paths 109 and 111. As the charged web is moving by the ionizer 9, the ion current $I_{n1}$ flows to the web 10 and a corresponding return current flows through the circuitry of the ionizer 9 to ground as $I_{rtn1}$. This electrical return current is conducted away from ionizer 9 and is substantially equal to the ion current flow $I_{n1}$ in accordance with Kirchhoff's current law. Since ionizer 11 preferably functions identically with ionizer 9, currents $I_{n2}$ and $I_{rtn2}$ flow through the circuit of ionizer 11 in a manner which is substantially identical to that described immediately above with respect to ionizer 9. Thus, the respective ion currents are preferably determined by measuring the associated return electrical currents, for example, with current meters 90 and 92 connected in the ground return paths 109 and 111.

Transformations of web charge density within a neutralization zone can be expressed mathematically beginning with the basic equation of charge conservation as described in detail below. An idealized web has width W and is moving with velocity v. Assuming that net charge density is evenly distributed across the width of the web, then for any type of static neutralization, the initial web electrical convection current is given by:

$$I_{upstream}=I_{n1}+I_{downstream} \quad \text{(Eqn. 1),}$$

where $I_{upstream}$ is the electrical convection current of the charges carried by the web 10 before it is neutralized by the ionizer 9; $I_{n1}$ is the external electrical current that partially or completely neutralizes charges on the web 10; and $I_{downstream}$ is the electrical convection current of the charges carried by the web 10 after it has been neutralized by the ionizer 9.

By definition, the electric convection current on the web and upstream of the neutralizer 9 is:

$$I_{upstream}=\sigma_w \cdot v \cdot W \quad \text{(Eqn. 2).}$$

Correspondingly, the electrical convection current on the web and downstream of the neutralizer 9 is:

$$I_{downstream}=\mathbf{94}_{n1} \cdot v \cdot W \quad \text{(Eqn. 3).}$$

Substituting the definitions of the initial (Eqn. 2) and residual (Eqn. 3) electrical currents into the law of conservation of charge (Eqn. 1) gives:

$$I_{n1}=(\sigma_w-\sigma_{n1}) \cdot v \cdot W; \quad \text{(Eqn. 4).}$$

Since static neutralization efficiency of neutralizer 9 is defined as:

$$\eta=\left(1-\frac{\sigma_{nl}}{\sigma_w}\right) \quad \text{(Eqn. 5)}$$

Web charge density before neutralization can be expressed as follows:

$$\sigma_w=\frac{I_{nl}}{v \cdot W} \cdot \frac{1}{\eta} \quad \text{(Eqn. 6)}$$

If both ionizers are of the same type and condition, their neutralizing efficiency values are substantially the same and are essentially independent of the web charge density being neutralized.

The expression for the initial charge density on the web upstream of ionizer 9 (Eqn. 6) can be modified to express the residual charge density downstream of the first of the two ionizers 9, as follows:

$$\sigma_{n1} = \frac{I_{n2}}{v \cdot W} \cdot \frac{1}{\eta} \quad \text{(Eqn. 7)}$$

From equations (6) and (7), the neutralization efficiency of the individual ionizers 9 and 11 can be defined as a ratio of two ion currents:

$$\eta = 1 - \frac{I_{n2}}{I_{n1}} \quad \text{(Eqn. 8)}$$

Finally, the initial web charge density can be expressed as:

$$\sigma_w = \frac{I_{n1}^2}{v \cdot W(I_{n1} - I_{n2})} \quad \text{(Eqn. 9),}$$

while the residual charge density can be expressed as:

$$\sigma_{res} = \sigma_w(1-\eta)^2 = \frac{I_{n2}^2}{v \cdot W(I_{n1} - I_{n2})} \quad \text{(Eqn. 11).}$$

From equations (9) and (11) the combined neutralization efficiency $\eta_{tandem}$ of the two ionizers 9 or 11 can be defined as a ratio of two ion currents:

$$\eta_{tandem} = 1 - \left(\frac{I_{n2}}{I_{n1}}\right)^2 \quad \text{(Eqn. 12).}$$

In accordance with the preferred embodiments of the present invention, the first and second ion currents are continually measured and the initial and residual charge density values are continually calculated. By way of example, if a 1.5-meter wide charged web is moving at a constant speed of 5 m/sec, and at a particular period of time the first ion current is measured to be 25 microamperes and the second ion current 1 microampere, the initial charge density and residual charge density values will be $3.5 \cdot 10^{-10}$ C/cm$^2$ and $5.6 \cdot 10^{-13}$ C/cm$^2$ respectively. The neutralizing efficiency of either one of the individual ionizer in the tandem system will be 0.96. By contrast, the neutralizing efficiency of both of the tandem of ionizers will be 0.9984. Thus, the resulting residual charge density is negligible.

As discussed below, the principles of the present invention can also be applied in cases where the upstream and downstream ionizers have different known neutralizing efficiency values, $\eta_1$ and $\eta_2$. Under such circumstances, the values of the initial and residual charge density can be expressed as follows.

$$\sigma_w = \frac{I_{n1}}{v \cdot W} \cdot \frac{1}{\eta_1} \quad \text{(Eqn. 13),}$$

$$\sigma_{res} = \frac{I_{n2}}{v \cdot W}(1 - \eta_2) \quad \text{(Eqn. 14).}$$

Alternatively, the residual charge density can also be expressed as follows.

$$\sigma_{res} = \sigma_w(1-\eta_1)(1-\eta_2) \quad \text{(Eqn. 15)}$$

If the neutralizing efficiency for each ionizer exceeds 90%, as it should if the appropriate equipment is selected, the initial and residual charge densities can be expressed as follows.

$$\sigma_w \approx \frac{1.1 \cdot I_{n1}}{v \cdot W} \quad \text{(Eqn. 16),}$$

$$\sigma_{res} \approx \frac{0.1 \cdot I_{n2}}{v \cdot W} \quad \text{(Eqn. 17).}$$

Using previously cited examples (1.5-meter wide charged web, moving at a constant speed of 5 m/sec, the first ion current 25 microamperes, the second ion current 1 microampere), the initial charge density and residual charge density values will be about $3.7 \cdot 10^{-10}$C/cm$^2$ and $13 \cdot 10^{-13}$C/cm$^2$ respectively.

With particular reference now to FIG. 2, there is shown a pictorial illustration of the ionizers 9, 11 which include ion emitter electrodes 47 and 49, ionizers 9 and 11 being connected to ground via respective ground return electrical paths 109 and 111. Ions are produced by the ion emitter electrodes 47, 49 positioned in proximity to the moving web 10. Operation of this embodiment is consistent with and will be readily understood in light of the description given above.

Another alternative variant of the present invention is shown in FIG. 3 where each of the ionizers 9 and 11 may be, for example, Ion Systems' Series 8000 Virtual AC™ Intelligent Static Neutralizers. The ionizers 9 and 11 of FIG. 3 each contain a pair of high-voltage generators 99*a* and 99*b*, and 110*a* and 110*b* respectively. Generators 99*b* and 110*b* are operated to produce only positive high ionizing voltages on respective outputs 80*a* and 80*b* that are connected to ion emitter electrodes 47*b* and 49*b*. Similarly generators 99*a* and 110*a* are operated to produce only negative high ionizing voltages on respective outputs 82*a* and 82*b* that are connected to the ion emitter electrodes 47*a* and 49*a*. The electrodes 47*a*, 47*b*, 49*a* and 49*ba* are conventionally formed as sharp tips or points oriented toward the moving web 10 so that surface charges can be neutralized by the ions emitted from the tips as is known in the art.

Each pair of the generators, 99*a* and 99*b*, and 110*a* and 110*b*, includes a common ground return electrical path 109, 111 respectively. Electrical charges having polarities opposite of the electrodes are conducted away from the generators at the rates corresponding to the rates of ion generation by electrodes 47 and 49. Under these conditions, the DC component of the current $I_{rtn1}$ and $I_{rtn2}$ in each of the common ground return path 109, 111 is substantially zero when there are substantially no external electrostatic fields from a charged surface in proximity with the ionizing electrodes 47*a*, 47*b*, 49*a* and 49*b*. However, responsive to the presence of charge on the adjacent surface of the web, ions of a polarity opposite to the surface charge on the web migrate away from the ionizer electrodes and flow to the charged surface. In the example shown in FIG. 3, the web 10 is charged positively. The electrostatic field of the web causes the negative ions to migrate away from the ionizing electrodes 47*a* and 49*a*, and flow to the surface of the charged material. The corresponding currents $I_{rtn1}$ and $I_{rtn2}$ that flow from the generators are measured or otherwise monitored in the ground returns 109 and 111. These return currents correspond to the ion currents $I_{n1}$ and $I_{n2}$ flowing from each of the ionizing devices 9 and 11 to the charged web. The charge density on the web is, thus, determined from normal operation of the ionizers 9 and 11, thereby obviating the need for additional charge sensors.

Figure 4:
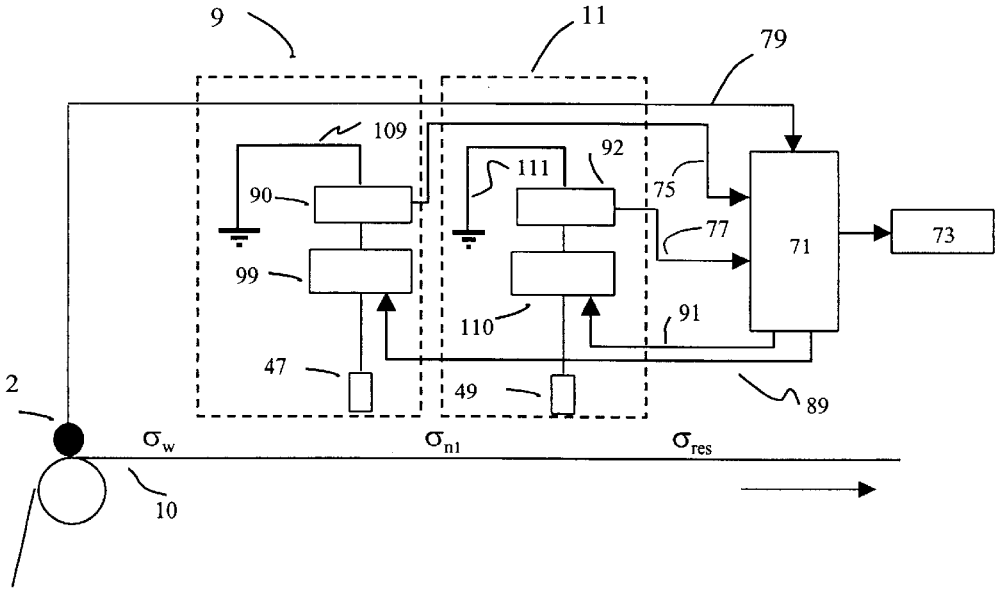
FIG. 4 is a schematic diagram of an apparatus embodiment of the web charge monitoring and neutralizing system of the present invention.

Referring now to FIG. 4, there is shown a schematic diagram of a more sophisticated system in accordance with one embodiment of the present invention. In this embodiment ionizers 9, 11 each include an ionizing electrode (or electrodes) 47 and 49 connected to respective high voltage generators 99 and 110. Generators 99 and 110 are, in turn, connected to the respective ground returns 109, 111 via the return current measuring circuits 90 and 92. An encoder 2 with a measuring wheel is engaged with the web 10 for measuring the web velocity and a microprocessor-based controller 71 collects data signals from the neutralizing current measuring circuits 90 and 92, and from encoder 2 via wiring 75, 77 and 79 respectively. Controller 71 then performs the mathematical functions expressed in the equations described above in order to determine a number of parameters discussed above such as the web charge density values. Controller 71 sends signals via wiring 89 and 91 to generators 99 and 110, respectively, to turn generators 99 and 110 on and off in response to the presence or absence web movement respectively. The controller 71 can also display the measured signals 75, 77 and 79 and can also display the initial and residual charge density values on the display 73. Additionally, controller 71 can store the measurements, calculations and control signals in memory and/or transmit them to other devices in a network.

Operation of the system depicted in FIG. 4 will now be discussed. Under normal operating conditions, moving web 10 of dielectric material accumulates static surface charge $\sigma_w$ in the course of moving over rollers, and the like, and such electrostatic charge should be neutralized, for example, to prevent discharges in the vicinity of flammable vapors. As regions of surface charge on the web 10 initially move into proximity with the upstream ionizer 9, air ions produced thereby are influenced by the electrostatic field associated with the initial charge $\sigma_w$ on the web 10. The generated air ions of a polarity opposite to the web charge are attracted to the web 10 and the corresponding electrical return currents from the generator flow through the return path 109. The electrical current sensing or monitoring circuit 90 supplies to controller 71 a signal 75 that is indicative of the polarity and density of the charge on web 10 upstream of ionizer 9. The resultant charge $\sigma_{n1}$ remaining on the web 10 after passing ionizer 9 is the initial level of charge to be neutralized by the downstream ionizer 11.

Ionizer 11 preferably operates in a manner substantially similar to that previously described with respect to ionizer 9. Additionally, the electrical current sensing or monitoring circuit 92 supplies to controller 71 a signal 77 that is indicative of the polarity and density of the charge on web 10 in the vicinity of ionizer 11.

The use of controller 71 results in a charge neutralization system of considerable flexibility. For example, controller 71 may continually monitor ion currents and determine their ratio. A sudden change of any of these values could indicate unexpected component failure, in which case the controller could generate an alarm signal that can be used to alert a user or shut down the machinery where the neutralizing system is installed, or select to run it with only one ionizer operational. It will be appreciated that redundant charge neutralization of the present invention reduces the possibility of total failure because one of the two ionizers can compensate for a sudden malfunction or complete failure of the other ionizer. This could, for example, enable continued safe operation after an alarm signal is generated and before manual corrective action has been taken. Naturally, use of third, fourth, etc. ionizers adds further levels of safety.

With the available information about the speed of the web and its width, the controller can also perform continuous calculations to determine the initial charge density $\sigma_w$ and the residual charge density $\sigma_{res}$. In addition, controller 71 is capable of calculating the neutralizing efficiency of each the ionizers 9 and 11 on the basis of the sensed ion currents $I_{n1}$ and $I_{n2}$. Controller 71 can also calculate the combined efficiency of both ionizers on the basis of the initial and resultant charges after passing both ionizers. Further, controller 71 can generate a signal that indicates if the residual charge on the web is low enough to continue safe operation or even if it is safe to speed up the line. Conversely, if the residual charge exceeds a predetermined safety level, controller 71 may generate a signal that can be used slow down or even stop the line to prevent further static charge accumulation. With two substantially identical ionizers operating at substantially the same and adequate neutralizing efficiencies, the residual charge $\sigma_{res}$ remaining on the web 10 will preferably be negligible after passing both upstream and downstream ionizers 9, 11.

A wide variety of ionizers can be used in the embodiments described above. For example, electrical as well as non-electrical ionizers can be utilized with the present invention. Electrical ionizers include AC ionizers, electrical steady-state bipolar DC ionizers, pulsed bipolar DC ionizers, combination bipolar DC/AC ionizers. Non-electrical ionizers include radioactive ionizers, passive or inductive ionizers and combination radioactive/passive ionizers. Other examples of ionizers will readily occur to those of ordinary skill in the art. The particular ionizer used in any given application will depend on a number of well known factors. The structure and features of a number of representative ionizers compatible with the present invention are discussed in detail below.

Electrical AC ionizers use 50/60 Hz alternating current (AC). The voltage at 50/60 Hz from the power outlet is stepped up by a remote high voltage transformer to 5,000 to 8,000 volts AC and applied to a row of sharp emitter pins. These emitter pins are surrounded by an electrically grounded metal enclosure and change polarity with the voltage. AC ionizers can use an electrically grounded metal enclosure or rails near the electrodes for ion generation. When the voltage exceeds the corona threshold, the pins generate positive and then negative ions. Ions are attracted to the charged web and neutralize it. However, if the web is neutral or carries a low surface charge, it will attract none or only a small number of ions of the necessary polarity. The excess ions, if any, will return to the electrodes or the grounded enclosure.

In DC ionizers the positive and negative DC voltages from the high voltage generators are applied in a conventional manner to two sets (rows) of emitter pins.

Bipolar pulsed-DC ionizers typically use pulsed DC voltages of positive and negative polarity supplied to separate ionizing electrodes and operate only one electrode at a time. Maximum pulse repetition frequency is limited by the rate of pulse voltage rise and decay and is typically no faster than about 5 Hz. Such ionizers generally use relatively large spacings (e.g., 3"–12") between the electrodes of opposite polarities. This low frequency makes pulsed DC ionizers of limited use for neutralization of surface charges on fast-moving webs.

Alpha, or radioactive ionizers, don't use electrical power. The energy for radioactive ionizers comes from a naturally occurring radioisotope, such as Polonium-210, which emits alpha particles. These alpha particles create positive and negative air ions upon collisions with air molecules. The low ionizing efficiency and effective range of alpha ionizers limit their use to slow-moving webs. Metal enclosures of radioactive ionizers are connected to earth ground to provide the source of electrical charges for neutralization. The ground current associated with the use of radioactive ionizers serves as the means to monitor the current flowing from the ionizer to the moving material.

Passive, or induction effect ionizers (sharp pins, strings of copper tinsel and other similar devices), also operate independently of electrical power. The ionizing effect of passive ionizers takes place when the electrical field of the charged web produces the corona effect at the sharp pins of the passive neutralizer. Metal enclosures of passive ionizers are connected to earth ground to provide the source of electrical charges for neutralization. These ionizers have to stay in close proximity to the charged material, and the charge on the material must be high enough so that the field at the electrode tips exceeds the threshold level of corona onset. The ground current associated with the use of radioactive ionizers serves as the means to monitor the ion current flowing from the ionizer to the moving material.

Virtual AC™ Neutralizer marketed by Ion Systems, Berkeley, Calif., is a combination bipolar DC/AC ionizer. It uses 50/60 Hz alternating current ionization. Unlike conventional AC ionizers, Virtual AC Neutralizers separate positive and negative ion generation between two sets of electrodes. One set of electrodes receives the positive half of the alternating current sine wave to generate positive ions, while the other set of electrodes receives the negative half of the sine wave to generate negative ions. When one set of electrodes has voltage applied, the electrodes of the other set are at a ground potential, thus providing a strong field necessary for ionization.

While any of the ionizers described above can be used in the present invention, some are more convenient to use than others. For example, it is relatively easy to design a practical electrical circuits to isolate and measure a component of a ground return current corresponding to the neutralizing current for Virtual AC™, DC and pulsed-DC ionizers. The same applies to ground return current associated with the use of passive and alpha ionizers. By contrast, AC ionizers are more difficult to use due to the need to distinguish the neutralizing current signal from the typically dominant electrical background noise.

What is claimed is:

1. A method of simultaneously neutralizing and monitoring the charge on a length of dielectric material moving in a downstream direction, the method comprising:

generating ions with a first ionizing device in a first location in proximity to the moving material;

generating ions with a second ionizing device in a second location downstream of the first location and in proximity to the moving material;

determining the initial charge density on the material upstream of the first ionizing device by measuring the ion current flowing from the first ionizing device to the material;

determining a residual charge density on the material downstream of the first and second ionizing devices by measuring the ion currents flowing from the first and second ionizing devices to the material; and generating a control signal in response to the determined charge densities.

2. The method of claim 1 wherein the step of determining the initial charge density comprises continually calculating values of the initial charge density as a function of material speed, material width, ion current flowing from the first ionizing device to the material and the neutralizing efficiency of the first ionizing device.

3. The method of claim 1 wherein the step of determining the residual charge density comprises continually calculating values of the residual charge density as a function of the initial charge density and the individual neutralizing efficiencies of the first and second ionizing devices.

4. The method of claim 1 wherein the first and second ionizing devices have substantially equal individual neutralizing efficiencies.

5. The method of claim 4 wherein the steps of determining the initial and residual charge densities comprise continually calculating values of the initial and residual charge densities as functions of material speed, material width and the first and second ion currents.

6. The method of claim 4 further comprising continually calculating the values of the individual and combined neutralization efficiencies of the first and second ionizing devices as a function of the first and second ion currents.

7. The method of claim 1 wherein the distance between the first and second locations is between about two and one hundred inches.

8. The method of claim 3 wherein the control signal can be used to change the velocity of the moving material until the residual charge density on the material is below a safety level.

9. The method of claim 1 wherein both of the first and second ionizing devices have individual neutralizing efficiencies exceeding about 90%.

10. The method of claim 9 wherein determining the initial charge density on the material comprises continually calculating values of the initial charge density as a function of material speed, material width and the first ion current.

11. The method of claim 9 further comprising continually calculating the values of the residual charge density as a function of material speed, material width and the second ion current.

12. The method of claim 1, wherein the first and second ionizing devices are selected from the group consisting of electrical ionizers, radioactive ionizers , and a combination radioactive/passive ionizers.

13. The method of claim 1, wherein the first ionizing device is a passive ionizer.

14. The method of claim 1, wherein the control signal can be used to display information relating to neutralizing the charge on the material.

15. The method of claim 1, wherein measuring the first and second ion currents comprises sensing the flow of electrical charges from each of the ionizing devices through a ground return of each ionizing device.

16. The method of claim 1, wherein the distance between the first and second locations is between about six and sixty inches.

17. A method of claim 1 wherein the length of the material is a free span of the material.

18. A method of claim 1 wherein the length of the material is a supported span of the material.

19. A method of claim 1 wherein the length of the material is a surface of roll of the material.

20. An apparatus for simultaneously neutralizing static charges and monitoring charge density values before and after neutralization on a length of dielectric material of a known width moving at a known speed in a downstream direction, the apparatus comprising:

a first ionizing device for generating ions in a first location in proximity to the material to thereby neutralize charge on the material;

a second ionizing device for generating ions in a second location downstream of the first location and in proximity to the material to thereby neutralize further charge on the material and only leave a residual charge on the material downstream of the second ionizing device;

a first circuit for measuring ion current flowing from the first ionizing device to the material;

a second circuit measuring ion current flowing through from the second ionizing device to the material;

a controller communicatively linked to the first and second circuits, the controller calculating values of the initial and residual charge density on the material from the values of the ion currents flowing from the first ionizer and from the second ionizer to the material and the controller generating a control signal as a function of the residual charge density on the material.

21. The apparatus of claim 20 wherein the control signal can be used to adjust the velocity of the moving material until the residual charge density on the material is below a safety level.

22. The apparatus of claim 21 wherein the controller calculates the residual charge density as a function of initial charge density and the individual neutralizing efficiencies of the first and second ionizing devices.

23. The apparatus of claim 21 wherein the controller calculates the residual charge density as a function of material speed, material width and the first and second ion currents.

24. The apparatus of claim 20 wherein the first and second ionizing devices ionizers selected from the group consisting of an electrical ionizer, a radioactive ionizer and a combination radioactive/passive neutralizer.

25. The apparatus of claim 20 wherein the moving material is a web.

26. An apparatus of claim 20 wherein the length of the material is a free span of material.

27. An apparatus of claim 20 wherein the length of the material is a supported span of material.

28. An apparatus of claim 20 wherein the length of the material is a surface of roll of material.

29. An apparatus for simultaneously neutralizing charge and monitoring charge density on a length of moving dielectric material of a known width moving at a known speed comprising:

means for generating charge-neutralizing ions in first and second spaced locations and in proximity to the moving material;

means for measuring ion currents flowing from the generating means to the moving material; and controller means communicatively linked to the measuring means, the controller means calculating values of initial and residual charge density on the material from the values of said ion currents and the controller means generating a control signal as a function of the residual charge density.

30. An apparatus for simultaneously neutralizing charge and monitoring charge density on a length of moving dielectric material of a known width moving at a known speed consisting essentially of:

means for generating charge-neutralizing ions in first and second spaced locations and in proximity to the moving material;

means for measuring ionizing current flowing from the generating means to the moving material; and controller means communicatively linked to the measuring means, the controller means calculating values of initial and residual charge density on the material from the values of said ion currents and the controller means generating a control signal as a function of the residual charge density.

* * * * *